US007051541B2

(12) United States Patent
Chung et al.

(10) Patent No.: US 7,051,541 B2
(45) Date of Patent: May 30, 2006

(54) ICEMAKER IN REFRIGERATOR

(75) Inventors: Eui Yeop Chung, Seoul (KR); Wook Yong Lee, Gwangmyeong-si (KR); Seung Hwan Oh, Seoul (KR); Myung Ryul Lee, Sungnam-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/814,229

(22) Filed: Apr. 1, 2004

(65) Prior Publication Data

US 2005/0066670 A1 Mar. 31, 2005

(30) Foreign Application Priority Data

Sep. 25, 2003 (KR) ..... 10-2003-0066598

(51) Int. Cl.
*F25C 5/08* (2006.01)

(52) U.S. Cl. ..... 62/137; 62/353

(58) Field of Classification Search ..... 62/73, 62/137, 353

See application file for complete search history.

(56) References Cited

U.S. PATENT DOCUMENTS

| | | | | |
|---|---|---|---|---|
| 3,146,601 A | | 9/1964 | Gould | |
| 4,614,088 A | | 9/1986 | Brooks | |
| 4,835,978 A | | 6/1989 | Cole | |
| 4,838,026 A | * | 6/1989 | Searl | 62/137 |
| 5,212,955 A | * | 5/1993 | Hogan | 62/73 |
| 5,992,167 A | | 11/1999 | Hill et al. | |
| 6,050,097 A | | 4/2000 | Nelson et al. | |
| 6,082,130 A | | 7/2000 | Pastryk et al. | |
| 6,148,620 A | * | 11/2000 | Kumagai et al. | 62/72 |
| 6,148,624 A | | 11/2000 | Bishop et al. | |
| 6,286,324 B1 | | 9/2001 | Pastryk et al. | |
| 6,314,745 B1 | | 11/2001 | Janke et al. | |
| 6,351,958 B1 | | 3/2002 | Pastryk et al. | |
| 6,574,974 B1 | | 6/2003 | Herzog et al. | |

FOREIGN PATENT DOCUMENTS

| | | |
|---|---|---|
| JP | 4-124570 | 4/1992 |
| KR | 1997-59568 | 12/1997 |

OTHER PUBLICATIONS

English Language Abstract of JP 04-124570.
English Language Abstract of Korean 1997-59668.

* cited by examiner

*Primary Examiner*—William E. Tapolcai
(74) *Attorney, Agent, or Firm*—Greenblum & Bernstein, P.L.C.

(57) ABSTRACT

Icemaker in a refrigerator for making ice automatically is disclosed. The icemaker in includes an ice tray provided to a door on the refrigerator for holding water, an ejector fitted adjacent to the ice tray so as to be rotatable by a motor for ejecting ice from the ice tray, means for detecting a rotation angle of the ejector, and a control part for controlling a rotation direction of the ejector based on information detected at the means.

19 Claims, 10 Drawing Sheets

ICEMAKER IN REFRIGERATOR

This application claims the benefit of the Korean Application No. P2003-66598, filed on Sep. 25, 2003, which is hereby incorporated by reference.

BACKGROUND OF THE INVENTION

1. Field of the Invention

The present invention relates to refrigerators, and more particularly, to an icemaker in a refrigerator for making ice automatically.

2. Background of the Related Art

The refrigerator is used for long time fresh storage of food. The refrigerator has food storage chambers each of which temperature is maintained in a low temperature state by a refrigerating cycle, for fresh storage of the food.

There are a plurality of storage chambers of different characteristics, so that the user can select storage methods suitable for storage of various kinds of food, taking kinds and characteristics of food and required storage time periods into account. Of the storage chambers, the refrigerating chamber and the freezing chamber are typical.

The refrigerating chamber is maintained at about 3° C.~4° C. for long time fresh storage of food and vegetable, and the freezing chamber is maintained at a subzero temperature for long time storage of meat and fish in a frozen state, and making and storage of ice pieces.

In the meantime, when it is intended to use ice, it is required to open a door on the refrigerating chamber, and take out the ice from an ice tray. In this case, the user is required to separate the ice from the ice tray, which is very difficult because the ice tray is at a very low temperature.

SUMMARY OF THE INVENTION

Accordingly, the present invention is directed to an icemaker in a refrigerator that substantially obviates one or more of the problems due to limitations and disadvantages of the related art.

An object of the present invention is to provide an icemaker in a refrigerator, which makes ice pieces automatically for user's easy and convenient taking out of ice pieces.

Other object of the present invention is to provide an icemaker of improved structure in a refrigerator, which can prevent splash of water from the icemaker when the door is opened or closed.

Another object of the present invention is to provide an icemaker of improved structure in a refrigerator, having a structure that can prevent splash of water from an ice tray, in which an ejector that ejects ice pieces from an ice tray is made to be controlled easily by using a simple structure.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the icemaker in a refrigerator includes an ice tray provided to a door on the refrigerator for holding water, an ejector fitted adjacent to the ice tray so as to be rotatable by a motor for ejecting ice from the ice tray, means for detecting a rotation angle of the ejector, and a control part for controlling a rotation direction of the ejector based on information detected at the means.

The icemaker further includes a dropper having a sloped surface covering a part of an upper part of the ice tray, and an overflow preventing member opposite to the dropper in the upper part of the ice tray.

The overflow preventing member is a panel extended upward by a length from the upper part of the ice tray. The panel includes a curved surface facing an inside of the ice tray, or the panel is vertical.

The icemaker further includes a heater for heating the ice tray when the water held in the ice tray is frozen.

The means includes a magnet fitted to a rotating body rotatably interlocked with a shaft of the motor, and at least two sensors fitted to a plate spaced from each other, the plate being arranged opposite to the rotating body, each for sensing a magnetic flux when the magnet comes close thereto, to measure a rotation angle of the ejector.

The rotating body is a driven gear rotatably engaged with a driving gear connected to the shaft of the motor, for rotating with the ejector.

The sensors include a first sensor for sensing an initial position of the ejector before the ejector ejects ice, and a second sensor for sensing a finish position when the ejector ejects the ice fully. A distance from a rotation center of the rotating body to the magnet is the same with a distance from a point of the plate opposite to the rotation center to each of the sensors. The second sensor is fitted in a range of angle of 170°~280° from the first sensor along a rotation direction of the rotating body.

The control part reverses the ejector when the second sensor senses the flux of the magnet. In this case, it is preferable that the ejector reverses until the first sensor senses the flux of the magnet.

The control part turns on the heater when water in the ice tray is frozen, and turns off when the second senor senses the flux of the magnet.

The sensors further include a third sensor fitted between the first sensor and the second sensor. In this instance, a distance from a rotation center of the rotating body to the magnet is the same with a distance from a point of the plate opposite to the rotation center to each of the sensors. The third sensor is fitted in a range of angle of 35°~145° from the first sensor along a rotation direction of the rotating body.

The control part turns on the heater when water in the ice tray is frozen, and turns off when the third senor senses the flux of the magnet.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings;

FIGS. 8A to 8C illustrate ejectors at initial positions; wherein

FIG. 8A illustrates a section of the icemaker showing a position of the ejector, FIG. 8B illustrates a front view of a driving gear and a driven gear showing a position of a magnet, and FIG. 8C illustrates a front view of a plate showing a position of a first sensor for sensing a flux of the magnet in FIG. 8B;

FIGS. 9A to 9C illustrate ejectors at positions at times a heater is turned off; wherein FIG. 9A illustrates a section of the icemaker showing a position of the ejector, FIG. 9B illustrates a front view of a driving gear, and a driven gear showing a position of a magnet, and FIG. 9C illustrates a front view of a plate showing a position of a third sensor for sensing a flux of the magnet in FIG. 9B; and FIGS. 10A to 10C illustrate ejectors at positions when the ejector finishes ejection of ice; wherein FIG. 10A illustrates a section of the icemaker showing a position of the ejector, FIG. 10B illustrates a front view of a driving gear, and a driven gear showing a position of a magnet, and FIG. 10C illustrates a front view of a plate showing a position of a second sensor for sensing a flux of the magnet in FIG. 10B.

DETAILED DESCRIPTION OF THE PREFERRED EMBODIMENT

Figure 1:
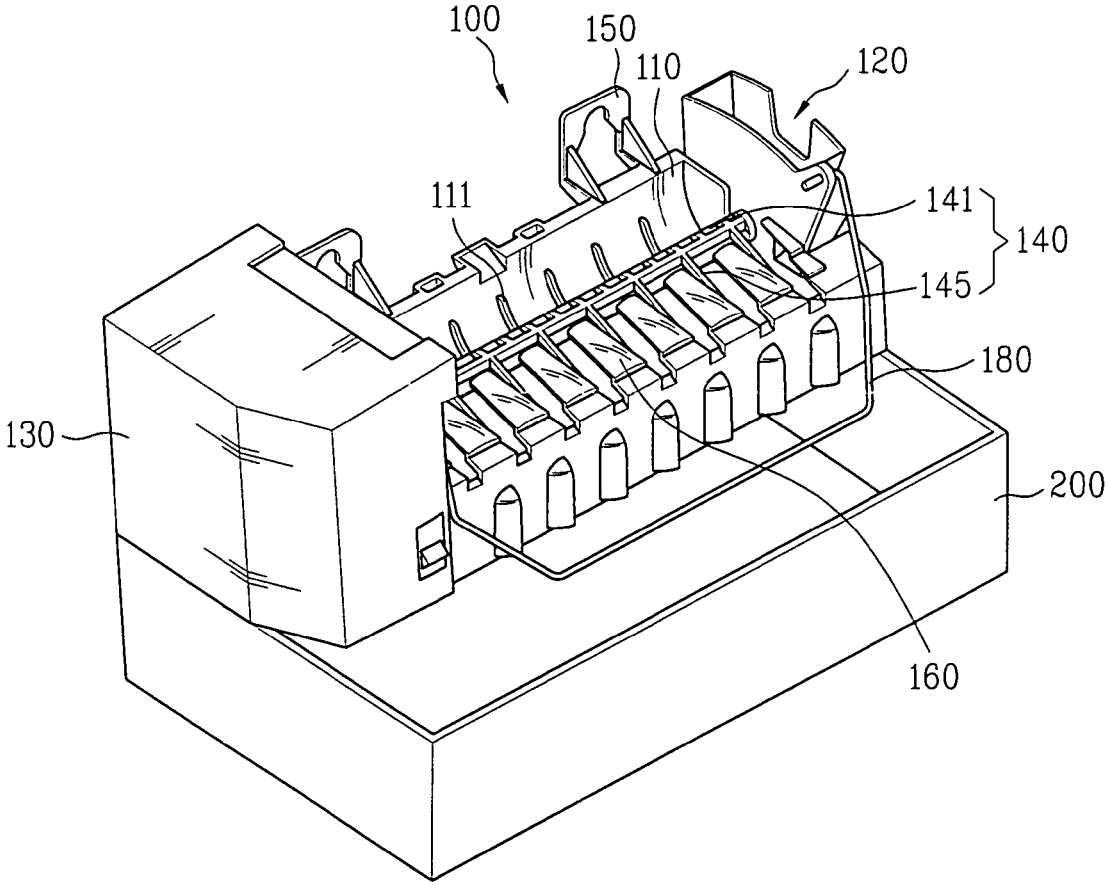
FIG. 1 illustrates a perspective view showing an icemaker and container in accordance with a first preferred embodiment of the present invention.

Reference will now be made in detail to the preferred embodiments of the present invention, examples of which are illustrated in the accompanying drawings. In describing the embodiments, same parts will be given the same names and reference numerals, and repetitive description of which will be omitted.

FIG. 1 illustrates a perspective view showing an icemaker 100 and container 200 in accordance with a first preferred embodiment of the present invention. The icemaker makes a plurality of ice pieces by using cold air in the freezing chamber, and the container 200 holds the ice pieces made at the icemaker 100. Therefore, once the icemaker 100 and the container 200 of the present invention are provided to the refrigerator, the user can use the ice pieces easily. Structures of the icemaker 100 and the container 200 will be described in more detail with reference to the attached drawings.

Referring to FIG. 1, the icemaker 100 is provided to, for an example, a freezing chamber of a refrigerator, and includes an ice tray 110, a water supplying part 120, an ejector 140, and a control box 130.

The ice tray 110 is semicylindrical with an opened top for storage of water and ice. The ice tray 110 has partition ribs 111 which divide an inside space of the ice tray into many small spaces. As shown in FIG. 1, the partition ribs 111 are projected to a radial direction from an inside surface of the ice tray 110. The partition ribs 111 makes the ice tray 110 to produce a plurality of ice pieces at a time.

The water supplying part 120 at one side of the ice tray 110 for supplying water to the ice tray 110. There are brackets 150 in a rear side of the ice tray 110 for fixing the icemaker 100 to the freezing chamber.

The ejector 140, arranged adjacent to the ice tray 110, includes a shaft 141, and a plurality of fins 145. The shaft 141, on an axis of the ejector 140, is arranged over an inside of the ice tray 110 to cross a central part along a length direction thereof. The fins 145 extend from an outside circumferential surface of the shaft 141 to a radial direction of the shaft 141. It is preferable that the fins 145 are formed at regular intervals along the length direction of the shaft 141, particularly, one of the fins 145 are arranged to every small space in the ice tray 110 formed by the partition ribs 111.

Referring to FIG. 1, the control box 130 is mounted at one outside surface of the ice tray 110. The control box 130 contains a motor (not shown), a driving gear 132, a driven gear 133, and the like, which will be described in more detail, with reference to FIGS. 2 and 3.

The driving gear 132 is connected to a shaft 131 of the motor (not shown), and rotated by the motor. The driven gear 133, rotatably engaged with the driving gear 132, has the shaft 141 of the ejector 140 connected thereto. Therefore, when the motor is operated, the driving gear 132 and the driven gear 133, engaged with each other, rotate, to rotate the ejector 140, accordingly.

Figure 2:
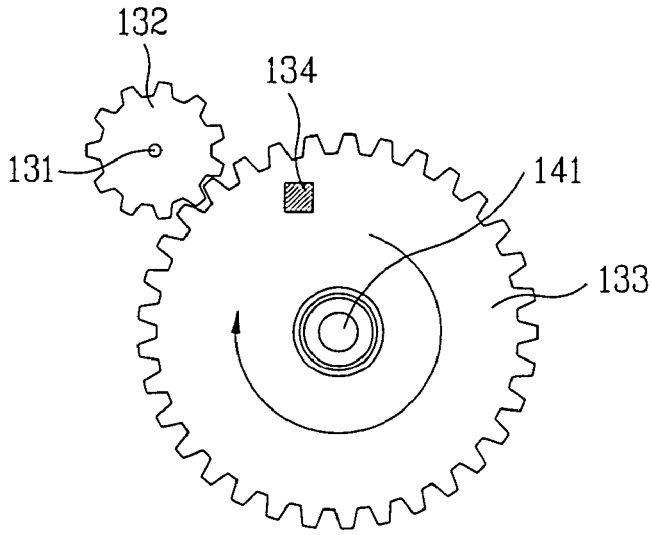
FIG. 2 illustrates a front view of a driving gear for rotating an ejector, and a driven gear having a magnet fitted thereto in the icemaker in FIG. 1.

Referring to FIG. 2, it is preferable that the driven gear 133 has more teeth than the driving gear 132, for slow ejection of ice from the ice tray 110 with the ejector 140 even if the shaft 131 of the motor rotates at a fast speed.

Figure 3:
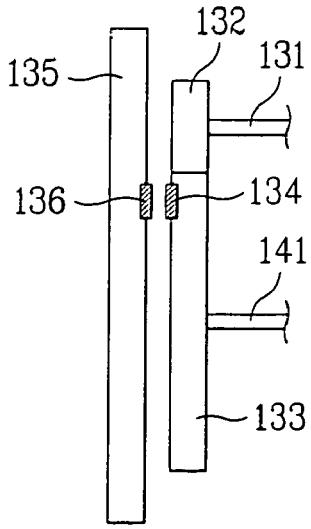
FIG. 3 illustrates a side view of the driving gear, the driven gear, and a plate having a sensor fitted thereto for sensing a flux of the magnet in FIG. 2.

In the meantime, in the icemaker 100 in accordance with a first preferred embodiment of the present invention, there is a device for detecting a rotation angle of the ejector 140 provided in the control box 130, which will be described with reference to FIGS. 2 and 3.

Referring to FIG. 2, there is a magnet 134 fitted to a surface of a rotating body rotatable interlocked with the shaft 131 of the motor, for an example, the driven gear 133. There is a plate 135 arranged opposite to the rotating body, i.e., the driven gear 133 in the control box 130, additionally. The plate 135 has a sensor 136 for sensing a flux of the magnet 134 fitted thereto. The plate 135 is stationary and fixed to the control box 130.

Therefore, when the driven gear 133 is rotated to bring the magnet 134 close to the sensor 136, the sensor 136 senses the flux of the magnet 134, such that the control part (not shown) detects a rotation angle of the ejector 140.

In the meantime, referring to FIG. 1, there are a plurality of droppers 160 in a front part of the ice tray 110, i.e., in an upper part of a side opposite to a side the brackets 150 are fitted thereto. The droppers 160 extend from the upper part of front part of the ice tray 110 to a part close to the shaft 141. There are small gaps between adjacent droppers 160, through which the fins 145 pass respectively when the shaft 141 rotates.

In the meantime, when the shaft 141 rotates, the ice in the ice tray 110 is pushed by the fins 145, separated from the ice tray 110, ejected through the opened top of the ice tray 110, and dropped on the droppers 160. The ice dropped onto the droppers 160 drops under the icemaker 100, and stored in the container 200 under the icemaker 100.

According to this, it is required that the upper surfaces of the droppers 160 guide the ice separated from the ice tray 110 to drop downward, well. Therefore, as shown in FIG. 1, in the present invention, it is preferable that the upper surfaces of the droppers 160 are sloped such that parts adjacent to the shaft 141 are positioned higher than the front side of the ice tray 110.

It is also required that a structure for preventing the ice pieces separated from the ice tray 110 by the fins 145 drop in a rear side of the ice tray 110. For this, as shown in FIG. 4, it is preferable that a rear side end of the ice tray 110 is positioned slightly higher than the shaft 141, so that the ice pieces, separated from the ice tray 110 as the ice pieces move to a rear side of the ice tray 110 by the fins 145, are guided to the front side of the ice tray 110, and drop on the upper surfaces of the droppers 160, naturally.

Figure 4:
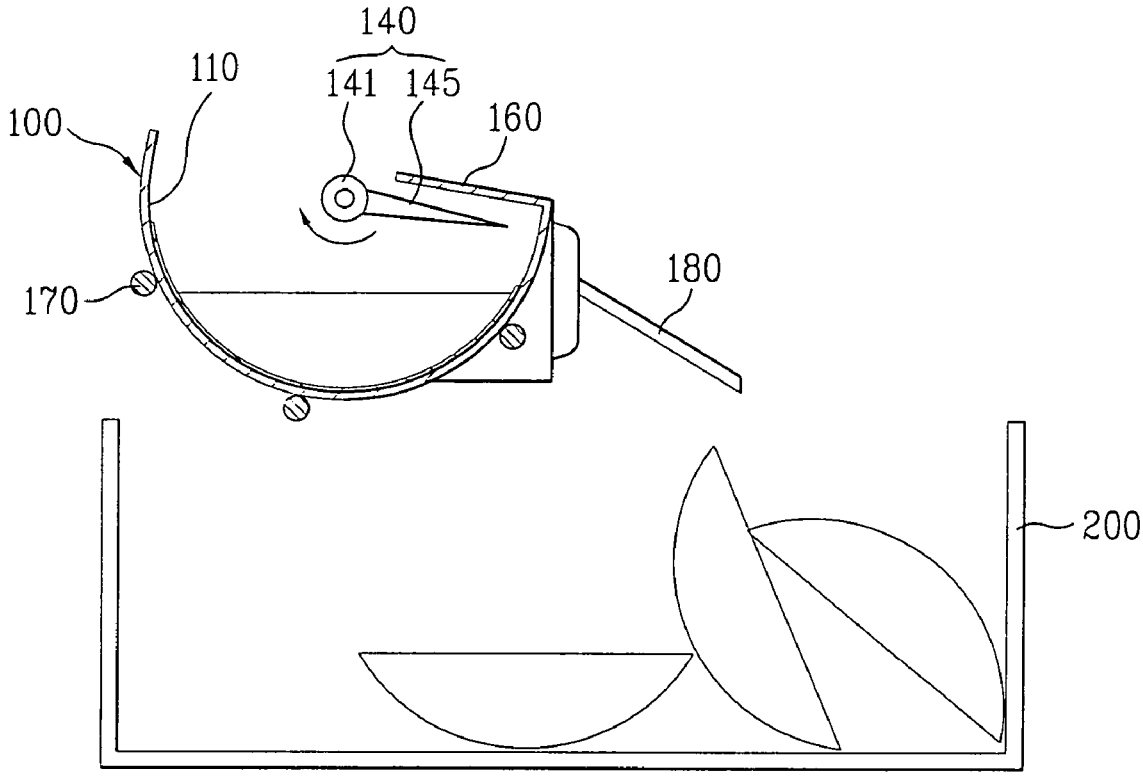
FIG. 4 illustrates a section of the icemaker and the container in FIG. 1, schematically.

In the meantime, as shown in FIG. 4, there is a heater 170 on an underside of the ice tray 110. When water supplied to the ice tray 110 is frozen, the heater 170 heats a surface of the ice tray 110 for a short period of time to melt the ice on a surface of the ice tray 110 slightly. Then, the ice pieces in the ice tray 110 are separated easily when the shaft 141 and the fins 145 are rotated.

The icemaker 100 of the present invention may be provided with a temperature sensor (not shown), additionally. The temperature senor is fitted to one side of the ice tray 110, for measuring a surface temperature of the ice tray 110. Therefore, the control part (not shown) can determine if the water supplied to the ice tray 110 is frozen with reference to a surface temperature of the ice tray 110 measured with the temperature sensor.

However, the icemaker 100 may not be provided with the temperature senor. In this case, the control part rotates the ejector 140 after a preset time period is passed after the supply of the water to the ice tray 110.

In the meantime, referring to FIGS. 1 and 4, the container 200 is arranged under the icemaker 100, and has an open top for receiving and storage of the ice pieces dropped from the icemaker 100.

Referring to FIGS. 1 and 4, the icemaker 100 of the present invention may be provided with a sensing arm 180 for measuring quantity of ice stored in the container 200, additionally. The sensing arm 180 moves up/down under the control of the control part (not shown) to measure quantity of ice in the container 200.

For an example, the sensing arm moves down at regular intervals, when a move down distance of the sensing arm 180 is great if the quantity of ice stored in the container 200 is small, and, opposite to this, a move down distance of the sensing arm 180 is small if the quantity of ice stored in the container 200 is much. Thus, the control part can measures the quantity of ice stored in the container 200 with reference to the move down distance of the sensing arm 180.

Thus, once the sensing arm 180 is provided to the icemaker 100, the icemaker 100 can continue or discontinue production of the ice depending on the quantity of the ice stored in the container 200.

The operation of the icemaker in the refrigerator in accordance with a first preferred embodiment of the present invention will be described.

When power is provided to the icemaker 100, the control part controls the motor to move the ejector 140 to an initial position. The initial position is a position (see FIG. 4) at which the fins 145 of the ejector 140 are set standby before the water supplied to the ice tray 110 is frozen.

When the ejector 140 is positioned at the initial position, the sensing arm 180 is operated. If the control part (not shown) determines that there is shortage of ice in the container 200 as a result of operation of the sensing arm 180, water is supplied to the water supplying part 120 of the icemaker 100.

The water supplied to the water supplying part 120 is filled in spaces between the partition ribs 111 of the ice tray 110, and frozen by cold air in the freezing chamber. According to this, many pieces of ice each having a fixed size are produced with the partition ribs 111 in the ice tray 110.

Once the ice is produced, the control part puts the heater 170 into operation. In this instance, full freeze of the water in the ice tray 110 is determined with reference to a surface temperature of the ice tray 110 the temperature sensor measured, or pass of a preset time period.

Upon putting the heater 170 into operation, the ice on the surface of the ice tray 110 melts slightly, and separated from the ice tray 110. Then, as the motor is operated, the shaft 141 and the fins 145 are rotated.

Then, the fins 145 push the ice pieces between the partition ribs 111 in a circumferential direction of the ice tray 110, such that the ice pieces, separated from the ice tray fully by the fins 145, are ejected through the open top of the ice tray 110, and drop onto the droppers 160. The ice pieces dropped onto the droppers 160 move along the sloped upper surface of the droppers 160, until the ice pieces drops down to the container 200 under the icemaker 100.

In the meantime, the motor keeps running during the ice ejection process. Therefore, the driven gear 133 keeps rotating in a clockwise direction in FIG. 4 together with the ejector 140. When the magnet 134 fitted to the driven gear 133 comes close to the sensor 136 as the driven gear keeps rotating, the sensor 136 senses a flux of the magnet 134. Then, determining that the ice pieces are ejected fully, the control part rotates the ejector 140 only to the initial position, and stops the ejector 140.

After the ejector 140 stops at the initial position, the sensing arm 180 senses quantity of the ice in the container 200. If it is determined that there is shortage of ice still with the sensing arm 180, above process is repeated, to keep production of ice pieces, until a certain amount of ice pieces are filled in the container 200 when the control part stops production of the ice with reference to the quantity of ice sensed by the sensing arm 180.

In the first embodiment described with reference to FIGS. 1 to 4, the icemaker 100 and the container 200 are provided to the freezing chamber of the refrigerator. Therefore, since the icemaker 100 and the container 200 occupy much of a volume of the freezing chamber, a space of the refrigerator can not be used, effectively.

In order to resolve such a problem, an idea may be suggested in which the icemaker 100 and the container 200 are mounted on the door. However, this case causes the following another problem. For production of ice, water is supplied to the ice tray 110 of the icemaker 100. However, when the door is opened in a state water is supplied to the ice tray 110, the water in the ice tray 110 washes heavily within the ice tray 110 by an inertia force, and shaking. According to this, a problem of splash of water from the ice tray 110 is caused when the door is opened and closed.

Therefore, the present invention suggests an icemaker of an improved structure which can prevent the splash of the water from the ice tray when the door is opened or closed, which will be described.

Figure 5:
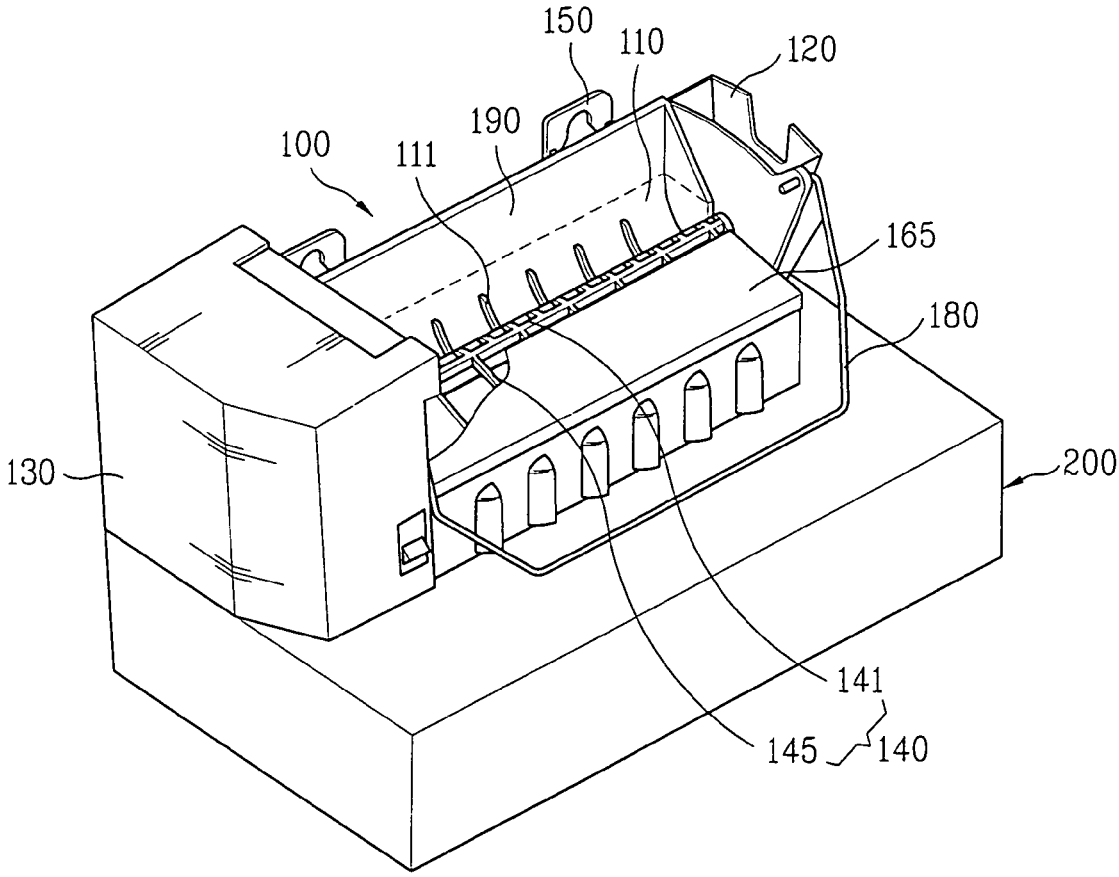
FIG. 5 illustrates a perspective view an icemaker and a container in accordance with a second preferred embodiment of the present invention.

FIG. 5 illustrates an icemaker 100 and a container 200 in accordance with a second preferred embodiment of the present invention. As shown in FIG. 5, structures of the icemaker 100 and the container 200 are similar to ones described with reference to FIG. 1. Therefore, the second embodiment will be described putting emphasis on characters of the second embodiment distinctive from the first embodiment hereafter. In describing the second embodiment, parts the same with the first embodiment will be given the same names and reference symbols.

In order to prevent the splash of water from the icemaker 100, the icemaker 100 in accordance with a second preferred embodiment of the present invention is also provided with a dropper 165 of an improved structure that can prevent the splash of water, and having an overflow preventing member 190. The overflow preventing member 190 and the dropper 165 are provided opposite to each other in an upper part of the ice tray 110 for preventing splash of water from the ice tray 110 when the door on the refrigerator is opened or closed.

Referring to FIG. 5, in the second embodiment, the dropper 165 covers a part of an upper part of the ice tray 110. That is, the dropper 165 is not provided with gaps for passing the fins 145 of the ejector 140. Therefore, even if water washes inside of the ice tray 110, the water does not splash over in the dropper side 165.

The overflow preventing member 190 is arranged opposite to the dropper 165 in the upper part of the ice tray 110. The overflow preventing member 190 may have a form of a panel extended upward by a length from the upper part of the ice tray. The panel may be curved or flat.

When the panel is curved, it is preferable that a surface facing an inside of the ice tray 110 is curved. Then, the water washing inside of the ice tray 110 is guided into the ice tray 110 after moving along the curved surface of the panel.

If the panel is flat, it is preferable that the panel stands vertical in the upper part of the ice tray 110. When the overflow panel 190 is vertical, the ice tray 110 and the overflow preventing member 190 can be fabricated as one unit easily by using one mold.

The overflow preventing member 190 and the dropper 165 without gap provided to the icemaker 100 in accordance with the second preferred embodiment of the present invention can prevent splash of water to an outside of the icemaker 100. According to this, the icemaker 100 and the container 200 can be mounted on the door of the refrigerator, thereby permitting effective use of the inside space of the refrigerator.

In the meantime, once the dropper 165 of above structure is provided, the ejector 140 can not rotate in one direction. Because the fins 145 of the ejector 140 are caught at the dropper 165 when the ejector 140 rotates greater than an angle from the initial position. According to this, the second embodiment of the present invention provides a structure which reverses the ejector 140 once the ejector 140 rotates to a position at which the ice is ejected fully.

For this, the icemaker 100 in accordance with the second embodiment of the present invention includes means for detecting a rotation angle of the ejector 140, and a control part for controlling a rotation direction of the ejector with reference to information detected at the means. The means includes a magnet 134, and at least two sensors for sensing a flux of the magnet 134 at positions different from each other, which will be described in detail with reference to the attached drawings.

Figure 6A:
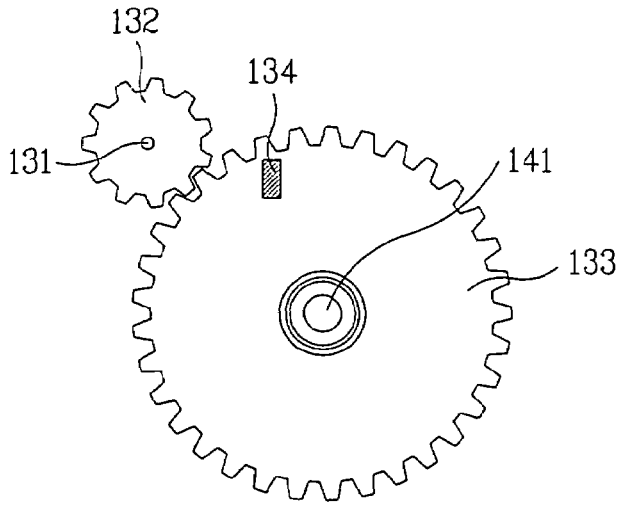
FIG. 6A illustrates a front view of a driving gear for rotating the ejector in FIG. 5, and a driven gear having a magnet fitted thereto.

Referring to FIG. 6A, the magnet 134 is fitted to a rotating body rotatably interlocked with a shaft 131 of a motor (not shown). Though the rotating body is fabricated separately and provided in the control box 130, for making the structure simple, and the box 130 compact, it is preferable that the magnet 134 is fitted to the driven gear 133. For reference, the driven gear 133, engaged with the driving gear 132 connected to the shaft 131 of the motor, rotates with the ejector 140.

Figure 6B:
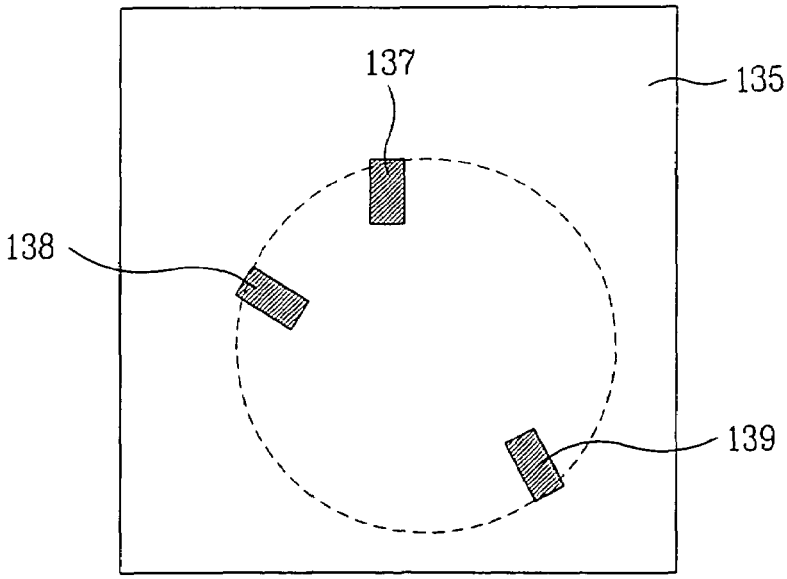
FIG. 6B illustrates a front view of a plate having sensors fitted thereto for sensing flux of the magnet in FIG. 6A.
Figure 7:
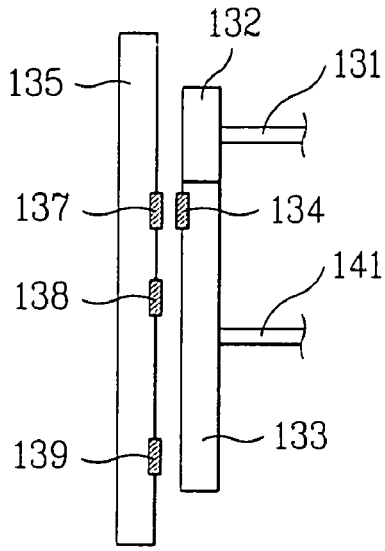
FIG. 7 illustrates a side view of the driving gear, the driven gear, and the plate in FIG. 6A or 6B, schematically.

The sensors are fitted to a plate 135, so that the sensors sense a flux when the magnet 134 comes close thereto. As shown in FIG. 6B, the plate 135 is arranged opposite to the rotating body, i.e., the driven gear 133, and the sensor are fitted to the plate 135 spaced from each other.

In the second embodiment of the present invention, two or three sensors are provided, which will be described hereafter.

At first, an embodiment with two sensors provided to the plate 135 will be described. The first sensor senses the initial position before the ejector 140 ejects ice, and the second sensor 138 senses a finish position at which the ejector 140 ejects ice, fully.

It is required that the first sensor 137 and the second sensor 138 sense the flux accurately when the magnet 134 comes close thereto, respectively. For this, it is preferable that a distance from a rotation center of the rotating body, i.e., the driven gear 133 to the magnet 134 is the same with a distance from one point of the plate 135 opposite to the rotation center of the driven gear 133 to the first sensor 137 or the second sensor 138.

In the meantime, the second senor 138 is arranged within a range of angle of approx. 170°~280° from the first sensor 137 depending on a rotation direction of the rotating body, i.e., the driven gear 133. Because the ice pieces is ejected from the ice tray 110 fully when the fins 145 of the ejector 140 rotates to above range of angle.

In the icemaker 100 with the two sensors, the control part determines that the ejector 140 ejects the ice fully when the second sensor 138 senses a flux after the ejector 140 is rotated. Therefore, the control part reverses the ejector 140 when the second sensor 138 senses the flux. Of course, the motor of the second embodiment is reversible.

When the ejector 140 reverses for the first sensor 137 to sense the flux of the magnet 134, the control part determines that the ejector 140 is at the initial position. According to this, the control part stops the ejector 140 when the first sensor 137 senses the magnetic flux after the ejector 140 reverses.

Once above structure is provided, if the ejector 140 ejects the ice fully, the ejector 140 stops at the initial position after the ejector 140 reverses. According to this, the icemaker 100 in accordance with the second embodiment of the present invention can control the ejector 140 easily only by using very simple structure.

In the meantime, when the heater 170 is provided to the icemaker 100 in accordance with the second embodiment of the present invention, the control part turns on the heater 170 when water in the ice tray 110 is frozen, and turns off the heater 170 when the second sensor 138 senses the flux of the magnet. When the heater 170 is controlled thus, a heating time period of the heater 170 can be reduced, not only to reduce power consumption, but also to prevent temperature rise of the freezing chamber by the heater 170.

Next, a case when three sensors are provided to the icemaker 100 in accordance with the second preferred embodiment of the present invention will be described. In this case, as shown in FIG. 6B, the plate 135 is provided with a third sensor 139 in addition to the first sensor 137 and the second sensor 138. Both the first sensor 137 and the second sensor 138 have the same positions and services with the first embodiment.

However, in a case the icemaker 100 is provided with the two sensors, since the heater turns off when the second sensor senses the flux, in a case three sensors are provided, the heater 170 turns off when the third sensor 139 senses the flux.

In the meantime, for accurate sensing of the flux of the magnet 134 at the third sensor 139, it is preferable that a distance from a rotation center of the driven gear 133 to the magnet 134 is the same with a distance from one point on the plate 135 opposite to the rotation center of the driven gear 133 to the third sensor 139.

Referring to FIG. 6B, the third sensor 139 is arranged between the first sensor 137 and the second sensor 138. In more detail, the third sensor 139 is arranged in a range of angle of approx. 35°~145° from the first sensor 137, depending on a rotation direction of the rotating body, i.e., the driven gear 133.

In the icemaker 100 with the three sensors, when the third sensor 139 senses the flux after the ejector 140 rotates, the control part turns of the heater 170. When the second sensor 138 senses the flux as the ejector 140 keeps rotating, the control part, determining that the ice is ejected fully, reverses the ejector 140.

When the first sensor 137 senses the flux after the ejector 140 reverses, the control part, determining that the ejector 140 is at the initial position, stops the ejector 140.

When the three sensors are provided to the icemaker 100, the icemaker 100 can turn off the heater 170 earlier than a case when the icemaker 100 has two sensors.

The operation of the icemaker 100 in accordance with a second preferred embodiment of the present invention having the foregoing structure will be described. In this instance, a process for producing ice in the icemaker 100, a process for the sensing arm measuring quantity of ice stored in the container 200, and the like are the same with the description given in the first embodiment. Therefore, only a process for the ejector 140 ejecting ice will be described.

Figure 8A:
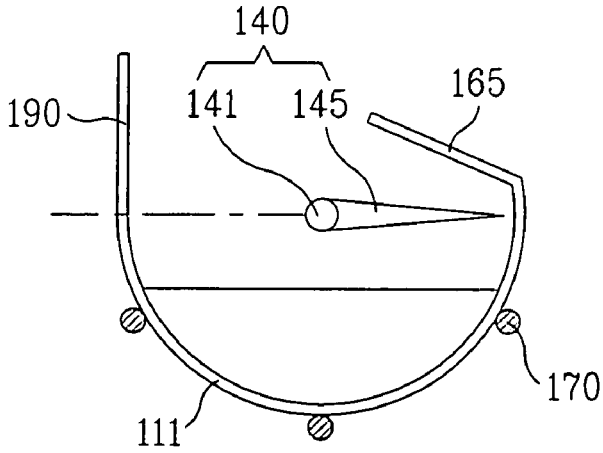
Figure 8B:
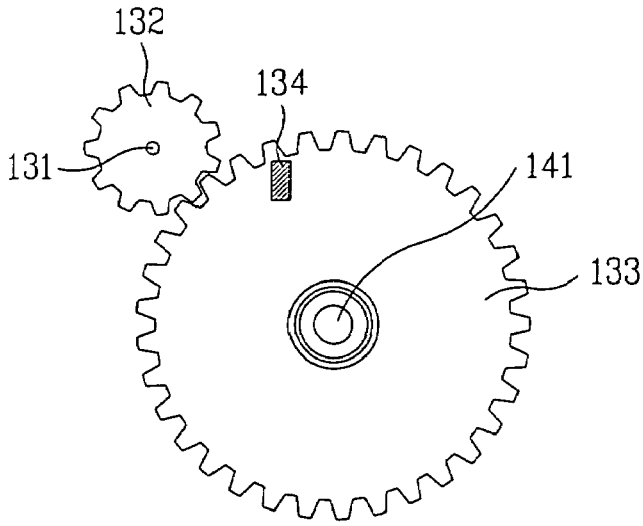
Figure 8C:
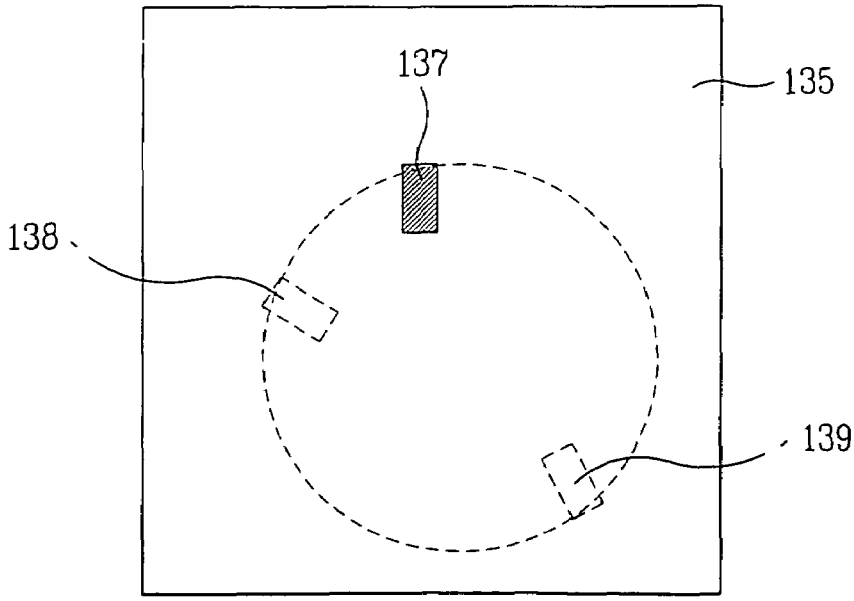

When power is provided to the icemaker 100, the ejector 140 is set at the initial position. In this instance, since a position the first sensor 137 senses the flux is the initial position, the control part can position the ejector 140 at the initial position, accurately. Positions of the fins 145, the magnet 134, and the sensors 137, 139, and 139 in a state the ejector 140 is at the initial position are shown well in FIGS. 8A~8C.

If water is supplied to the ice tray 110, and the ice is produced in a state the ejector 140 is at the initial position, the control part puts the heater 170 into operation. A surface temperature of the ice tray 110 rises as the heater 170 is operated, to separate the ice from the ice tray 110.

Figure 9A:
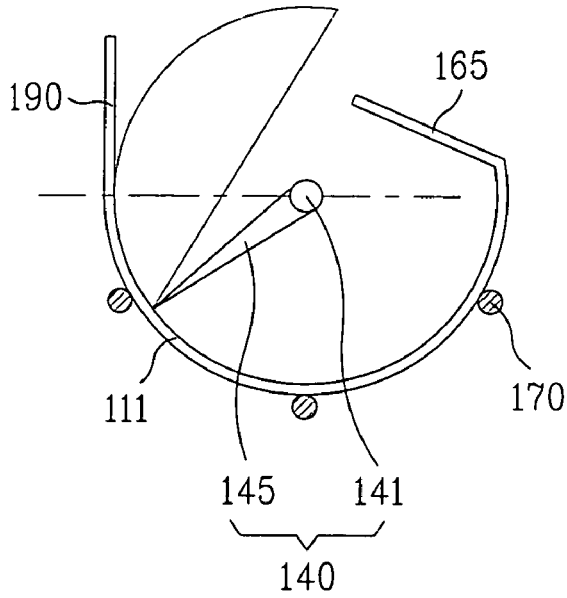
Figure 9B:
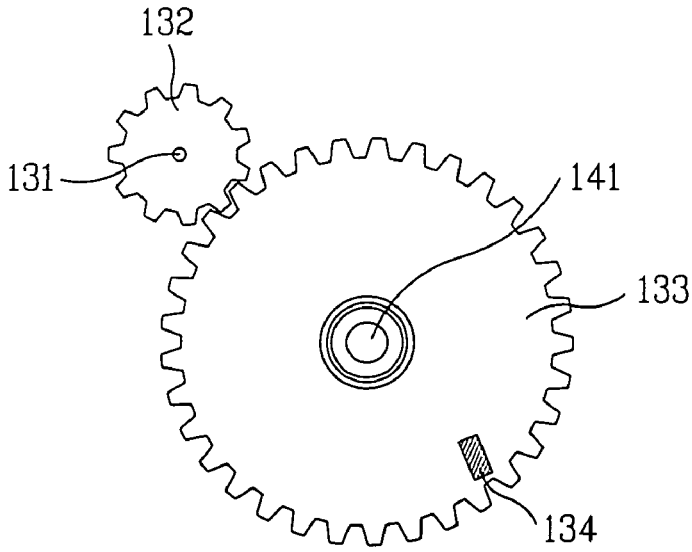
Figure 9C:
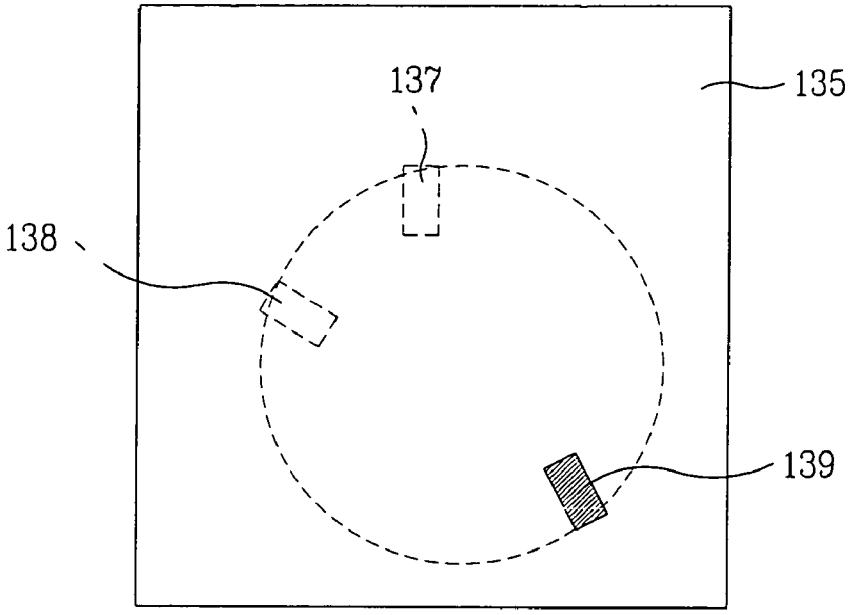

Then, the control part puts the motor into operation, to rotate the ejector 140. Then, as the driven gear 133 rotates, a position of the magnet 134 also changes. The ejector 140 rotates until the magnet 134 comes to a position opposite to the third sensor 139. In this instance, positions of the fins 145, the magnet 134, and the sensors 137, 138, and 139 are illustrated in FIGS. 9A~9C, well. When the third sensor 139 senses the flux, the control part turns off the heater 170.

Figure 10A:
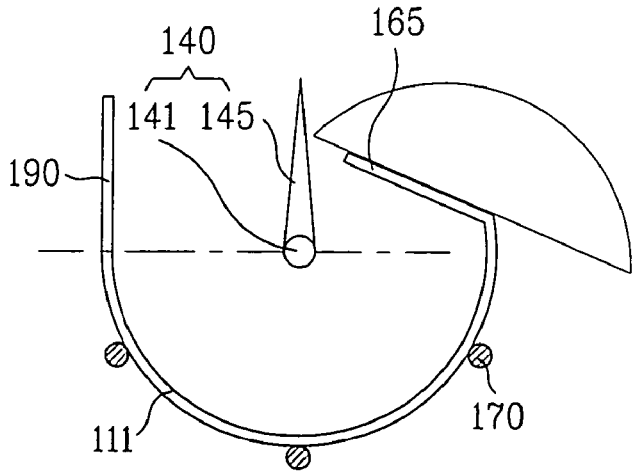
Figure 10B:
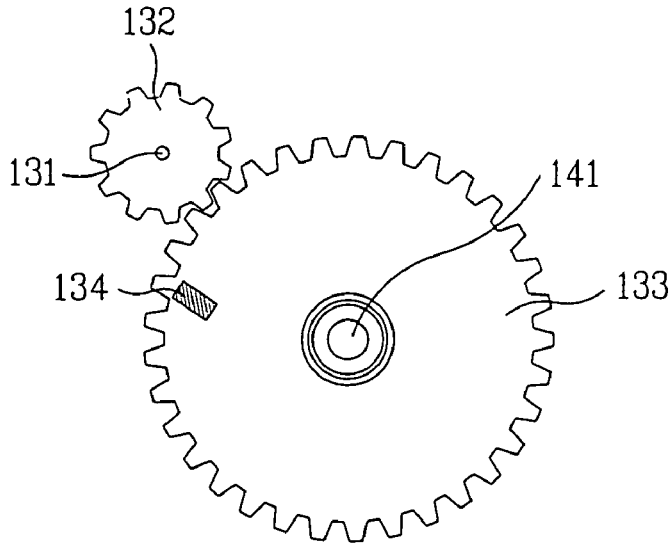
Figure 10C:
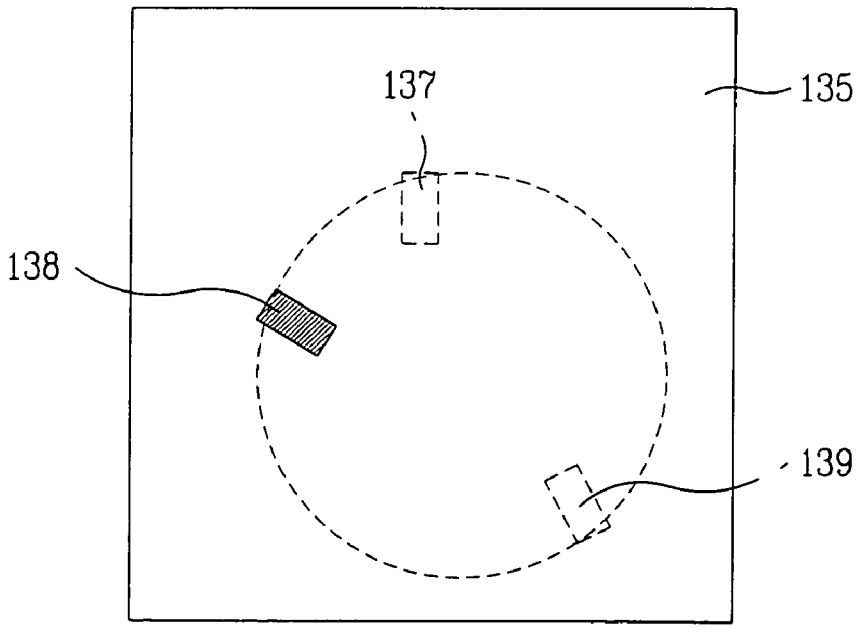

After the heater 170 is turned off, the ejector 140 keeps rotating. Accordingly, after a short time period, the magnet 134 faces the second sensor 138. In this instance, positions of the fins 145, the magnet 134, and the sensors 137, 138, and 139 are illustrated in FIGS. 10A~10C, well. When the second senor 138 senses the flux, the control part, determining that the ice is ejected fully, reverses the ejector 140.

In the meantime, in the case only two sensors 137, and 138 are provided to the icemaker 100, when the second sensor 138 senses the flux, the ejector 140 is rotated, and, at the same time with this, the heater 170 is turned off.

If the first sensor 137 senses the flux of the magnet 134 again after the ejector 140 reverses, the control part, determining that the ejector 140 is at the initial position, stops the ejector 140.

If there is shortage of ice in the container 200 in a state the ejector 140 is stopped, above process is repeated after water is supplied to the ice tray 110. However, if there is enough ice in the container 200, no water is supplied to the ice tray 110, to stop production of the ice.

As has been described, the structure of the present invention has the following advantages.

First, the automatic ejection of the many pieces of ice produced at the ice tray permits the user to take out ice pieces from the container any time with convenience and easy without giving an effort of separating the ice from the ice tray.

Second, the dropper with the overflow preventing member and without the gaps provided to the ice tray can prevent splash of water in opening or closing of the door on the refrigerator. According to this, the icemaker can be mounted on the door on the refrigerator, and an inside space of the refrigerator can be used, effectively.

Third, the ejector and the heater can be operated effectively, even with a simple structure having at least two sensors and one magnet. An operation time period of the heater can be shortened, to reduce an energy consumption.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An icemaker in a refrigerator comprising:

an ice tray provided to a door on the refrigerator for holding water;

an ejector fitted adjacent to the ice tray so as to be rotatable by a motor for ejecting ice from the ice tray;

a detector that detects a rotation angle of the ejector;

the detector including:

a magnet fitted to a rotating body rotatably interlocked with a shaft of the motor; and at least two sensors fitted to a plate spaced from each other, the plate being arranged opposite to the rotating body, each sensor senses a magnetic flux when the magnet comes close thereto, to measure a rotation angle of the ejector; and a control part for controlling a rotation direction of the ejector based on information detected at the detector.

2. The icemaker as claimed in claim 1, further comprising:

a dropper having a sloped surface covering a part of an upper part of the ice tray, and an overflow preventing member opposite to the dropper in the upper part of the ice tray.

3. The icemaker as claimed in claim 2, wherein the overflow preventing member is a panel extended upward by a length from the upper part of the ice tray.

4. The icemaker as claimed in claim 3, wherein the panel includes a curved surface facing an inside of the ice tray.

5. The icemaker as claimed in claim 3, wherein the panel is vertical.

6. The icemaker as claimed in claim 1, wherein the rotating body is a driven gear rotatably engaged with a driving gear connected to the shaft of the motor, for rotating with the ejector.

7. The icemaker as claimed in claim 1, wherein the sensors include;

a first sensor for sensing an initial position of the ejector before the ejector ejects ice, and a second sensor for sensing a finish position when the ejector ejects the ice fully.

8. The icemaker as claimed in claim 7, wherein a distance from a rotation center of the rotating body to the magnet is the same as a distance from a point of the plate opposite to the rotation center to each of the sensors.

9. The icemaker as claimed in claim 7, wherein the second sensor is fitted in a range of angle of 170°~280° from the first sensor along a rotation direction of the rotating body.

10. The icemaker as claimed in claim 7, wherein the control part reverses the ejector when the second sensor senses the flux of the magnet.

11. The icemaker as claimed in claim 10, wherein the ejector reverses when the first sensor senses the flux of the magnet.

12. The icemaker as claimed in claim 7, further comprising a heater for heating the ice tray when water held in the ice tray is frozen.

13. The icemaker as claimed in claim 12, wherein the control part turns on the heater when water in the ice tray is frozen, and turns off when the second senor senses the flux of the magnet.

14. The icemaker as claimed in claim 12, wherein the sensors further include a third sensor fitted between the first sensor and the second sensor.

15. The icemaker as claimed in claim 14, wherein a distance from a rotation center of the rotating body to the magnet is the same as a distance from a point of the plate opposite to the rotation center to each of the sensors.

16. The icemaker as claimed in claim 14, wherein the third sensor is fitted in a range of angle of 35°~145° from the first sensor along a rotation direction of the rotating body.

17. The icemaker as claimed in claim 14, wherein the control part turns on the heater when water in the ice tray is frozen, and turns off when the third senor senses the flux of the magnet.

18. The icemaker in claim 2, wherein the dropper is provided with no gap through which the ejector passes so that water in the ice tray is prevented from overflowing through the dropper.

19. An icemaker in a refrigerator comprising:

an ice tray provided to a door on the refrigerator for holding water;

an ejector fitted adjacent to the ice tray so as to be rotatable by a motor for ejecting ice from the ice tray;

a dropper having a sloped surface covering a part of an upper part of the ice tray, the dropper with no gap through which the ejector passes so that water in the ice tray is prevented from overflowing through the dropper;

a detector detecting a rotation angle of the ejector; and a control part for controlling a rotation direction of the ejector based on information detected at the detector.

* * * * *

UNITED STATES PATENT AND TRADEMARK OFFICE

CERTIFICATE OF CORRECTION

PATENT NO. : 7,051,541 B2
APPLICATION NO. : 10/814229
DATED : May 30, 2006
INVENTOR(S) : E. Y. Chung et al.

It is certified that error appears in the above-identified patent and that said Letters Patent is hereby corrected as shown below:

On the Title Page of the printed patent, at Item (56), References Cited, Foreign Patent Documents, "1997-59568" should be --1997-59668--.

On the Title Page of the printed patent, at Item (57), Abstract, line 3, after "icemaker" delete "in".

At column 11, line 29 (claim 13, line 3) of the printed patent, "senor" should be --sensor--.

At column 12, line 11 (claim 17, line 3) of the printed patent, "senor" should be --sensor--.

Signed and Sealed this

Twentieth Day of February, 2007

JON W. DUDAS
*Director of the United States Patent and Trademark Office*